US005463834A

United States Patent [19]

Krieger

[11] Patent Number: 5,463,834

[45] Date of Patent: Nov. 7, 1995

[54] TETHERING STAKE

[76] Inventor: John M. Krieger, 4568 Lahm Dr., Akron, Ohio 44319

[21] Appl. No.: 207,372

[22] Filed: Mar. 7, 1994

[51] Int. Cl.[6] ..... E02D 5/80; E04H 15/62

[52] U.S. Cl. ..... 52/155; 135/118; D30/154

[58] Field of Search ..... 52/162, 163, 166, 52/148; 135/118; D30/99, 154

[56] References Cited

U.S. PATENT DOCUMENTS

| | | | |
|---|---|---|---|
| 243,351 | 2/1977 | Laukhuf | 30/44 |
| 245,032 | 7/1977 | Hoffmann | 30/44 |
| 245,536 | 8/1977 | Meyer | 248/75 |
| 250,281 | 11/1978 | Laukhuf | 30/44 |
| 250,488 | 12/1978 | Wilmot | 119/117 |
| 287,156 | 12/1986 | Sloane | 253/254 |
| 298,975 | 12/1988 | Pantoja et al. | 30/154 |
| D. 300,507 | 4/1989 | Rabb | 367/349 |
| D. 314,328 | 2/1991 | Cobb . | |
| D. 351,692 | 10/1994 | Cossey | D30/154 |
| 362,183 | 5/1887 | Runyon | 135/118 |
| 716,010 | 12/1902 | Eldridge | D30/154 |
| 1,008,323 | 11/1911 | Gillespie . | |
| 1,161,303 | 6/1914 | Fritz . | |
| 1,555,322 | 9/1925 | Kleinhesselink . | |
| 1,566,846 | 12/1925 | Fielding . | |
| 1,592,128 | 7/1926 | Steinbreder . | |
| 1,724,401 | 8/1929 | Green et al. . | |
| 1,724,688 | 9/1929 | Wickstrum | 135/118 |
| 1,781,350 | 11/1930 | Taylor . | |
| 2,340,447 | 2/1941 | Aiken | 52/162 |
| 2,863,535 | 12/1958 | Clapper . | |
| 2,910,149 | 10/1959 | Lionberger | 189/29 |
| 3,280,829 | 10/1966 | Glendenning et al. | 135/15 |
| 3,280,830 | 10/1966 | Zweben . | |
| 3,550,343 | 12/1970 | Buske | 52/704 |
| 3,772,838 | 11/1973 | Virnig | 52/160 |
| 4,825,600 | 5/1989 | Osgood, Sr. | 52/155 |
| 4,831,798 | 12/1987 | Otteson | 52/153 |
| 4,953,576 | 5/1989 | Connelly | 135/118 |
| 5,199,214 | 8/1992 | Caldwell | 47/135 |
| 5,226,829 | 5/1992 | Jones | 138/118 |

OTHER PUBLICATIONS

Tidy Post Company Advertisement, Feb. 2, 1949.

*Primary Examiner*—Carl D. Friedman
*Assistant Examiner*—W. Glenn Edwards
*Attorney, Agent, or Firm*—Frederick K. Lacher

[57] ABSTRACT

A ground attaching assembly for confining an attached object to a limited distance from a predetermined ground position includes an elongated stake member having a ground penetrating end and a driven impact end spaced from the penetrating end. The driven impact end is capable of receiving blows from an associated pounding member such as a hammer. An object securing line is connected to the stake member at an attachment position between the penetrating end and the driven impact end, providing space between the attachment position and the impact end whereby the securing line may be spaced from the impact end and thereby be protected from blows from the associated pounding member.

12 Claims, 3 Drawing Sheets

TETHERING STAKE

This invention relates to a tethering stake which can be mounted below ground level and which provides unrestricted rotatory movement of a chain or other securing line about the tethering stake.

Tethering stakes are known in the art and are generally effective for their intended purpose. However, prior art tethering stakes have been associated with certain difficulties and inadequacies in performance. One problem is the danger presented to humans by tripping over or falling upon a tethering stake protruding from above the ground. A second problem concerns the tendency of an associated chain or securing line to wrap around the stake itself, thereby limiting the range of movement of whatever may be tethered to the stake, such as a pet animal. A third problem is the likelihood of damaging the tethering stake or the securing line in the process of pounding the tethering stake into the ground. These and other problems in the art are overcome by the present invention.

In accordance with one aspect of the invention, there is provided a tethering stake for securing an associated object to a certain location in the ground, the tethering stake comprising:

an elongated stake member having a penetrating end spaced from an impact end, the impact end having an impact surface for receiving blows from an associated pounding device, the stake member having a cross-sectional shape with inward and outward surfaces; and, a securing line for securing the associated object to the tethering stake, the securing line being fixedly attached to the tethering stake at an attachment position between the impact end and the penetrating end of the tethering stake, the attachment position being on the inward surface and spaced a predetermined distance from the impact end of the tethering stake thereby protecting the securing line from the blows from the associated pounding device.

In accordance with another aspect of the invention, there is provided a method of securing an object to a certain location in the ground, the method utilizing a securing tethering stake comprising an elongated stake member and securing line member having at least three inter connected links at one end, the method comprising the steps of:

fixing a first link of the securing line to the stake member at an attachment position, the attachment position being spaced a predetermined distance from an impact surface of an impact end of the stake member;

positioning second and third links of the securing line away from the impact surface of the impact end of the stake member, thereby protecting the securing line member from the blows from the associated pounding device;

pounding on an impact end of the stake member until the impact end of the stake member is just below the surface of the ground; and, positioning the second link of the securing line generally vertically so that the second link extends vertically just above the impact end of the stake member and the third link rotates freely about the second link and the impact end of the stake member.

In accordance with another aspect of the invention, a ground attaching assembly for confining an attached object to a limited distance from a predetermined ground position comprises:

an elongated stake member having a ground penetrating end and a driven impact end spaced from the penetrating end for receiving blows from an associated pounding member;

an object securing line fastened to the stake member at an attachment position between the penetrating end and the driven impact end providing space between the attachment position and the impact end whereby the securing line is spaced from the impact end and is thereby protected from the blows from said associated pounding member.

IN THE DRAWINGS

DESCRIPTION OF THE PREFERRED EMBODIMENTS

Figure 2:
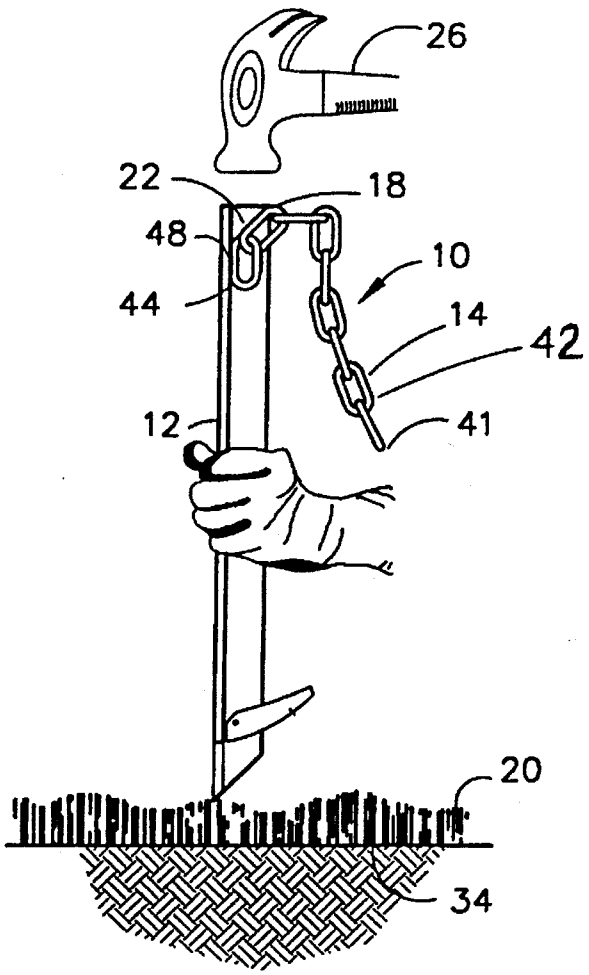
FIG. 2 is an elevational view of a tethering stake according to the invention, shown just prior to the tethering stake being pounded into the ground.
Figure 1:
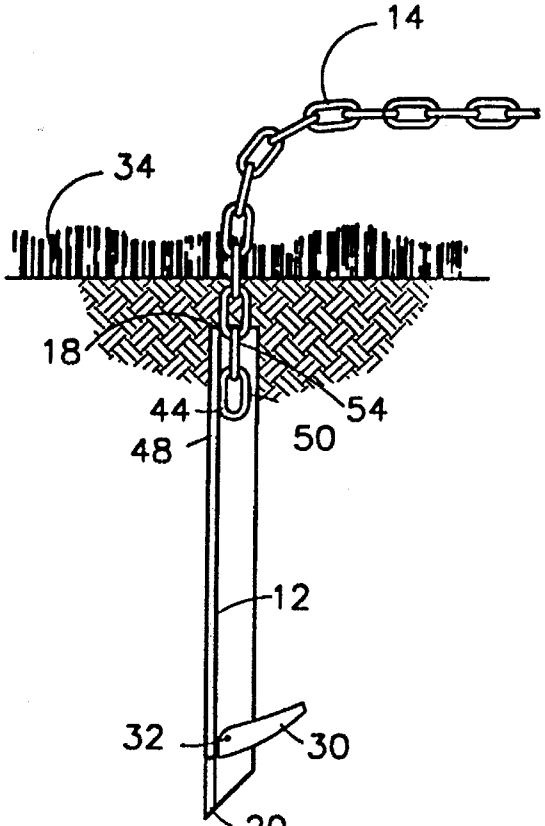
FIG. 1 is an elevational view of a tethering stake according to the invention, showing the stake in an installed position with an impact end of the stake located beneath ground surface.

Referring to FIGS. 1–9, the structure and method of operation of the preferred embodiments of the invention will be described. With particular reference to FIGS. 1 and 2, a tethering stake 10 according to the invention includes an elongated stake member 12 and a securing line 14. The stake member 12 includes an impact end 18 and a penetrating end 20. The impact end 18 has an impact surface 22 for receiving blows from an associated pounding device, such as a hammer 26.

In a preferred embodiment, the tethering stake 10 also includes a swingable barb 30 which is capable of locking the stake 10 into position in the ground, as indicated in FIG. 1. The barb 30 is swingably connected to the elongated stake member 12 near the penetrating end 20 of the stake member via pin 32. When the tethering stake 10 is being pounded into the ground, the ground surrounding the stake tends to swing the barb 30 close to the elongated stake member 12, as indicated in FIG. 2. Once the tethering stake 10 is in position beneath the ground surface, as indicated in FIG. 1, tension on securing line 14 to pull elongated stake member 12 out of the ground causes the barb 30 to swing outwardly from the elongated stake member 12 about pin 32, thus locking the elongated stake member 12 in position beneath the ground surface 34.

With particular reference to FIGS. 3–8, the stake member 12 has a cross-sectional shape with inward and outward surfaces 38,40, respectively. With particular reference to FIGS. 4–8, the cross-sectional shape may be V-shaped, U-shaped, or C-shaped, or other shapes which provide an inward area to which the securing line can be affixed. The inward surface 38 can be understood to be that surface closest to a centroid of the cross-sectional shape of the elongated stake member 12, as the term "centroid" is defined in classical static mechanics. The outward surface 40 of each cross-sectional shape is, of course, the surface farthest from the centroid.

Figure 3:
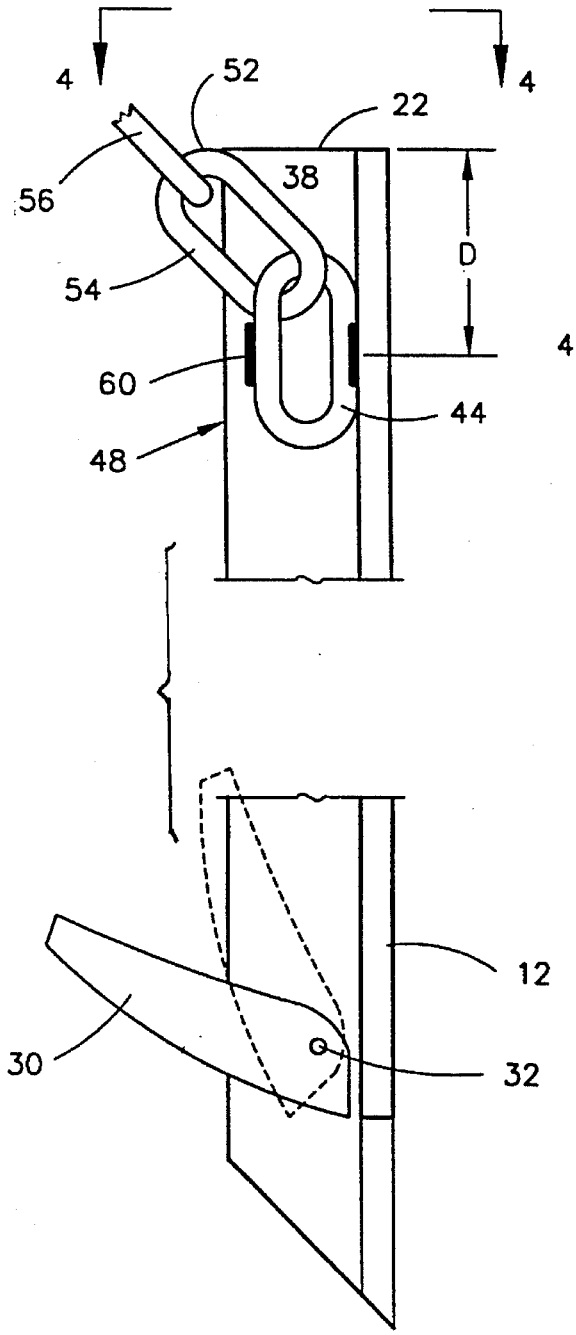
FIG. 3 is a side view of one embodiment of a tethering stake, broken in the middle to show both the impact end and the penetrating end of the stake.
Figure 4:
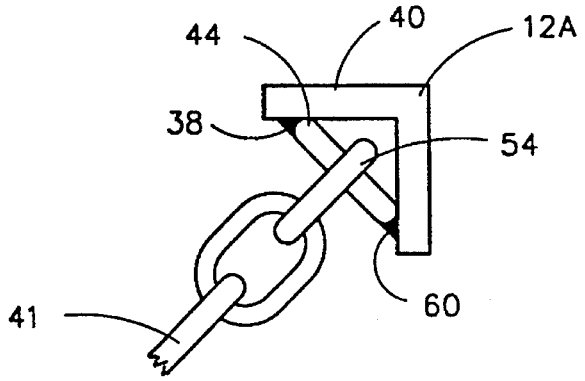
FIG. 4 is a top view of the tethering stake shown in FIG. 3.

One important element of the invention is the manner of affixing the securing line 14 to the stake member 12. One preferred embodiment of securing line is a chain 41. The chain 41 is typically comprised of links 42. One end 44 of the chain 41 is attached to the impact end 18 of the tethering stake 10 at an attachment position 48. A preferred form of attachment is by welding, such as welding both sides of a first link 50 of the chain to the inward surface 38 of the tethering stake 10 as shown in FIG. 4. With reference to FIG. 3, the attachment position 48 is spaced from the impact surface 22 a distance D. In a preferred embodiment, the distance D is at least as long as the length of one link of the chain 41 so that one end 52 of second link 54 of the chain extends just above the impact surface 22. As can be seen in FIGS. 1 and 2, it is important that second link 54 be above, rather than below, the first link 50 when the sides of the first link 50 are welded to the inward surface 38 of the tethering stake 10.

With reference to FIG. 1, this arrangement is advantageous in providing free rotation of the third link 56 about the end 52 of the second link 54. In essence, the second link 54 acts as a pivotal connection about which the third and subsequent links of the chain 41 can freely rotate. This prevents or reduces the possibility of the chain 41 wrapping around the tethering stake 10 and always provides the entire length of the securing line 14 to the tethered object, for example a pet animal, for a maximum range of movement.

Alternate embodiments of the tethering stake 10 are shown in FIGS. 4–8. In each of the embodiments, both sides of the first link 50 of the chain 41 are welded to inward surfaces 38 of the elongated stake member 12. The welds 60 fix the first link 50 to the elongated stake member 12 but the second link 54, third link 56 and subsequent links of the chain are free to rotate about the first link 50.

Figure 5:
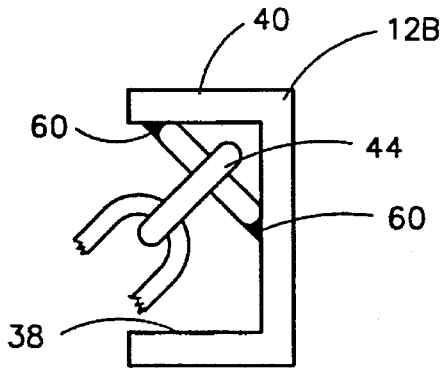
FIG. 5 is a top view of an alternate embodiment of a tethering stake.
Figure 6:
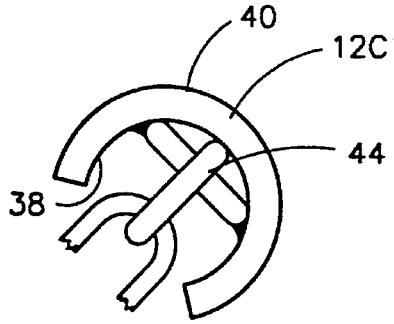
FIG. 6 is a top view of another alternate embodiment of a tethering stake.

With reference to FIG. 4, a preferred embodiment of the invention has the stake member 12A with a V-shaped cross-sectional shape such as angle iron. With reference to FIG. 5, the stake 12B with a U-shaped cross-sectional area is shown, such as a channel. With reference to FIG. 6, the stake 12C with a C-shaped semi-circular cross-sectional area is shown.

Figure 7:
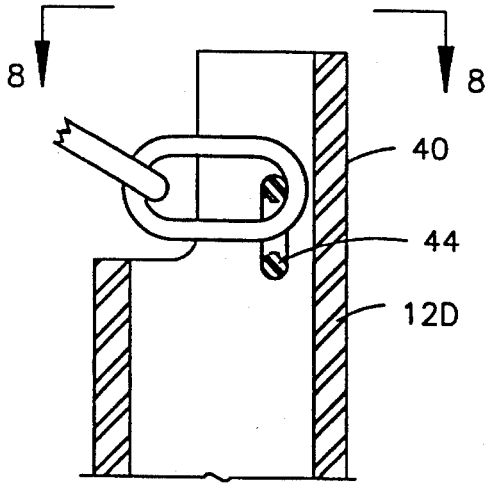
FIG. 7 is a side cross-sectional view of a further alternate embodiment of a tethering stake.
Figure 8:
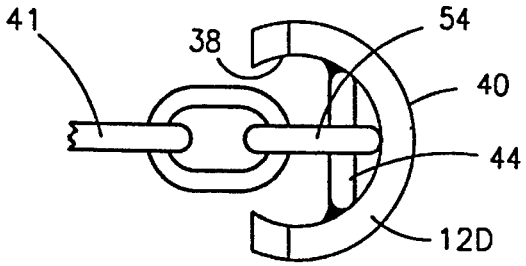
FIG. 8 is a top view taken along line 8—8 of FIG. 7 of an alternate embodiment of a tethering stake.

With reference to FIGS. 7 and 8, another embodiment of the invention has a stake member 12D with a cylindrical cross-section such as a cylindrical pipe having a portion of one end and one side of the pipe removed. This embodiment has additional advantages, as it can be manufactured from an existing section of pipe.

Figure 9:
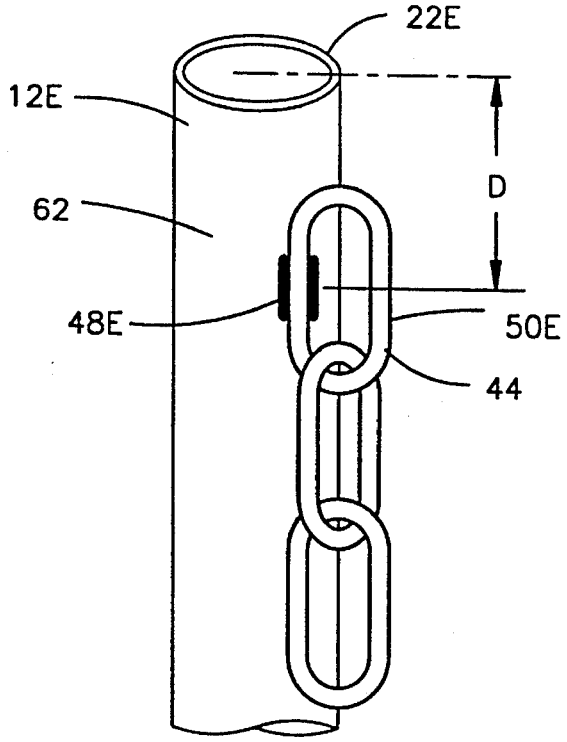
FIG. 9 is a side view of a still further alternate embodiment of a tethering stake.

With reference to FIG. 9, a further embodiment of the invention has a stake member 12E with a cylindrical cross section such as a cylindrical pipe with the one side of the first link 50 welded to an outer surface 62 at an attachment position 48E spaced a distance D from the impact surface 22E.

While certain representative embodiments and details have been shown for the purpose of illustrating the invention, it will be apparent to those skilled in the art that various changes and modifications may be made therein without departing from the spirit or scope of the invention.

What is claimed is:

1. An article for securing an associated object to a certain location in the ground, said article comprising:

an elongated stake member having a penetrating end spaced from an impact end, said stake member having the same cross-sectional shape with an inward and outward surfaces extending from said penetrating end to said impact end, an impact surface for receiving blows from an associated pounding device, said stake member being adapted for being pounded until said impact end is just below the surface of the ground; and, a securing line for securing said associated object to said stake member, said securing line being fixedly attached to said stake member at an attachment position on said inward surface between said impact end and said penetrating end of said article, said attachment position being spaced a distance from said impact end of said article thereby protecting said securing line from said blows by said associated pounding device.

2. The article of claim 1 wherein said cross-sectional shape is "V-shaped."

3. The article of claim 1 wherein said cross-sectional shape is "U-shaped."

4. The article of claim 1 wherein said cross-sectional shape is "C-shaped."

5. The article of claim 2 wherein said article is made of angle iron.

6. The article of claim 5 wherein said article is made of a split section of pipe.

7. The article of claim 1 wherein said securing line is a chain comprised of a plurality of links.

8. The article of claim 7 wherein one of said links is fastened to said article at said attachment position and said distance said attachment position is spaced from said impact end is at least as long as the length of one link of said chain so that a portion of one link of said chain extends above said impact end of said article to form a pivotal connection about which the rest of said chain rotates.

9. The article of claim 7 wherein said chain comprises first, second and third links, said first link being interlocked with said second link and being welded to said article at said attachment position, said second link extending just above said impact end of said article, said third link being interlocked with said second link and freely rotating with the remainder of said chain about said impact end of said article.

10. A method of securing an object to a certain location in the ground, said method utilizing a securing article comprising an elongated stake member and securing line having at least three inter connected links at one end, said method comprising the steps of:

fixing a first link of said securing line to said stake member at an attachment position, said attachment position being spaced a distance from an impact surface of an impact end of said stake member;

positioning a second and third links of said securing line away from said impact surface of said impact end of said stake member, thereby protecting said securing line from said blows from said associated pounding device;

pounding on an impact end of said stake member until said impact end of said stake member is just below the surface of the ground; and, positioning said second link of said securing line generally vertically so that said second link extends vertically just above said impact end of said stake member and said third link is freely rotatable about said second link and said impact end of said stake member.

11. The method of claim 10 wherein said stake member has a cross-sectional shape with inward and outward surfaces, and said first link is fastened to an inward side of said stake member.

12. An article for securing an associated object to a certain location in the ground, said article comprising:

an elongated stake member having a penetrating end spaced from an impact end, said impact end having an impact surface for receiving blows from an associated pounding device, said stake member being adapted for being pounded until said impact end is just below the surface of the ground, said stake member having a cross-sectional shape with inward and outward surfaces, said cross-sectional shape being "V-shaped", said stake member being made of angle iron;

a securing line for securing said associated object to said article, said securing line being a chain comprised of a plurality of links, said securing line being fixedly attached to said article at an attachment position between said impact end and said penetrating end of said article, said attachment position being on said inward surface, said attachment position being spaced a distance from said impact end of said article thereby protecting said securing line from said blows by said associated pounding device, one of said links of said chain being fastened to said article at said attachment position and said distance said attachment position is spaced from said impact end is at least as long as the length of one link of said chain so that a portion of one link of said chain extends above said impact end of said article to form a pivotal connection about which the rest of said chain rotates, said chain comprising first, second and third links, said first link being interlocked with said second link and being welded to said article at said attachment position, said second link extending just above the ground and said impact end of said article, said third link being interlocked with said second link and freely rotating with the remainder of said chain about said impact end of said article; and, a barb, said barb being capable of locking said article into position in the ground, said barb swingably connected to said article near said penetrating end and swingable about an axis, said barb swinging inwardly toward said stake member when said stake member is being pounded into the ground and outwardly after said article has been mounted into the ground.

* * * * *